US006495255B2

(12) United States Patent
Tsutsui et al.

(10) Patent No.: US 6,495,255 B2
(45) Date of Patent: Dec. 17, 2002

(54) POLYOLEFIN SPLITTABLE CONJUGATE FIBER AND A FIBER STRUCTURE USING THE SAME

(75) Inventors: Toshihiko Tsutsui, Shiga-ken (JP); Masaru Nishijima, Shiga-ken (JP); Kazuyuki Sakamoto, Shiga-ken (JP)

(73) Assignees: Chisso Corporation, Osaka (JP); Chisso Polypro Fiber Co., Ltd., Tokyo (JP)

( * ) Notice: Subject to any disclaimer, the term of this patent is extended or adjusted under 35 U.S.C. 154(b) by 0 days.

(21) Appl. No.: 09/888,047

(22) Filed: Jun. 22, 2001

(65) Prior Publication Data

US 2002/0037408 A1 Mar. 28, 2002

(30) Foreign Application Priority Data

Jun. 26, 2000 (JP) ..... 2000-190868

(51) Int. Cl.[7] ..... D01F 8/00; D01F 8/06

(52) U.S. Cl. ..... 428/370; 428/373; 428/374

(58) Field of Search ..... 428/370, 373, 428/374

(56) References Cited

U.S. PATENT DOCUMENTS

| | | | | | |
|---|---|---|---|---|---|
| 4,234,655 | A | * | 11/1980 | Kunimune et al. | 428/374 |
| 4,323,626 | A | * | 4/1982 | Kunimune et al. | 428/373 |
| 6,174,603 | B1 | * | 1/2001 | Berger | 428/370 |
| 6,228,490 | B1 | * | 5/2001 | Nagano et al. | 428/370 |

FOREIGN PATENT DOCUMENTS

| | | | |
|---|---|---|---|
| JP | 4-289222 | | 10/1992 |
| JP | 2001032138 | * | 2/2001 |

* cited by examiner

*Primary Examiner*—N. Edwards
(74) *Attorney, Agent, or Firm*—Merchant & Gould P.C.

(57) ABSTRACT

Disclosed herein is a polyolefin splittable conjugate fiber comprising at least two components of polyolefin resins (including polystyrene resins) and having a cross sectional structure with each of the components arranged alternately, wherein at least one of the component resins contains 1–30% by weight of an ethylene-vinyl alcohol copolymer whose saponification degree is 95% or more. Using the splittable conjugate fiber of the invention, a fiber structure having a fine and even surface can be provided.

7 Claims, 2 Drawing Sheets

POLYOLEFIN SPLITTABLE CONJUGATE FIBER AND A FIBER STRUCTURE USING THE SAME

TECHNICAL FIELD

This invention relates to a highly splittable polyolefin conjugate fiber and more particularly to the fiber which is suitable for the fields of industrial materials such as battery separator, wiper and filter and the like, and hygienic materials such as diaper, napkin and the like; and to a fiber structure using the same and to a process producing the fiber structure.

BACKGROUND ART

As is known, an islands-sea type or splittable type conjugate fiber is conventionally used to produce an extremely fine fiber. The production method using the islands-sea type conjugate fiber comprises spinning combined resins as plural components and removing one of the obtained conjugate fiber components by dissolution to give an extremely fine fiber. Although a very fine fiber can be obtained, this method is uneconomical in that one of the components needs to be removed by dissolution. On the other hand, the production method using the splittable fiber comprises spinning combined resins as plural components and splitting the conjugate fiber obtained into a large number of extremely fine fibers by utilizing a physical stress or a difference in shrinkage between the fiber-constituting resin components when immersed in a chemical.

A typical splittable conjugate fiber, for example, a combination of a polyester resin with a polyolefin resin, a polyester resin with a polyamide resin or a polyamide resin with a polyolefin resin, has poor compatibility with each other due to polymers of different kinds in the fiber, and though splitting proceeds easily, the resulting extremely fine fiber and fiber structure composed thereof have poor chemical resistance due to functional groups in the polymers. This restrains an application of these conjugate fibers to the field of industrial materials which require chemical resistance.

On the other hand, a combination of polyolefin resins each having a strong resistance to chemicals shows better compatibility than that of the different polymers as mentioned above, and therefore strong physical impact is needed to split the splittable fiber formed. This causes so-called unevenness in the resulting nonwoven such as split parts and non-split parts, or thick parts and thin parts due to a partial movement of fibers caused by the physical impact. Thus, the nonwoven shows a poor uniformity. Further, the processing speed in hydroentangling needs to be greatly reduced so as to diminish undivided parts. For these reasons, this type of combination is unsatisfactory.

JP-A-4-289222 discloses an improvement that a splittable conjugate fiber comprising polymers of the same kind is easily split by addition of organosiloxanes or modifiers thereof. Though the improvement is somewhat successful in respect of splittability, there still remain many problems such as reduction in strength of the nonwoven made with such fibers and poor processability during the secondary processing period, and the like.

An object of the present invention is to provide a polyolefin splittable conjugate fiber that is easy to split and a fiber structure with a fine surface and good uniformity using the same.

The present inventors have found, as a result of investigations, that a splittable conjugate fiber comprising at least two components of polyolefin resins, wherein at least one component containing 1–30% by weight of ethylene-vinyl alcohol copolymer whose saponification degree is 95% or more, is easy to split and that a fiber structure obtained by using the conjugate fiber has a fine surface and good uniformity. This finding has led to the present invention.

DISCLOSURE OF THE INVENTION

The present invention is composed of the following:

The first invention is concerned with a polyolefin splittable conjugate fiber comprising at least two components of polyolefin resins (including polystyrene resin, this also applicable hereinafter) and having a cross sectional structure with each of the components arranged alternately, wherein at least one of the component resins contains 1–30% by weight of ethylene-vinyl alcohol copolymer whose saponification degree is 95% or more.

In a preferred embodiment of the invention, each component of the polyolefin resins comprises a polypropylene resin phase and a polyethylene resin phase.

In a further preferred embodiment of the invention, at least one component of the polyolefin resins comprises a stereoregular polystyrene resin.

In another preferred embodiment of the invention, the polyolefin splittable conjugate fiber is a hollow fiber.

In another preferred embodiment of the invention, a foaming agent is added to at least one component of the polyolefin resins.

In another preferred embodiment of the invention, the splittable conjugate fiber has a bent, bulged or flat cross section.

The second invention is concerned with a fiber structure using the polyolefin splittable conjugate fiber obtained in the first invention.

The third invention is concerned with a process for producing the said fiber structure, which comprises the steps of mixing the polyolefin splittable conjugate fiber of the first invention with a fiber comprising a resin having a lower melting point, subjecting the fiber having a lower melting point to thermal bonding and subsequently splitting the said splittable conjugate fiber.

Figure 1:
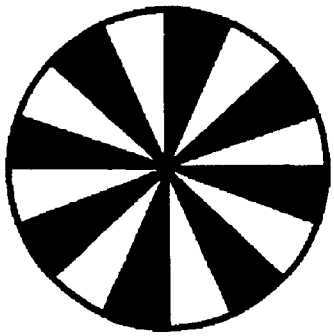
FIG. 1 is a cross sectional diagram of a splittable conjugate fiber in the present invention.

The code shall be explained below:

1: a hollow part

BEST MODE FOR CARRYING OUT THE INVENTION

The present invention shall specifically be explained below.

Polyolefin resins used for the polyolefin splittable conjugate fiber of the present invention include homopolymers of aliphatic α-olefin having 2–8 carbons such as ethylene, propylene, 1-butene, 1-pentene, 4-methyl-1-pentene, 3-methyl-1-butene, 1-hexene and 1-octene; copolymers comprising two or more olefins mentioned above; copolymers comprising one or more of the above olefins and a small amount of other unsaturated monomers such as butadiene, isoprene, 1,3-pentadiene, styrene, α-methylstyrene and the like; and mixtures of two or more of the above polymers.

Among these polyolefin resins, polypropylene resin and polyethylene resin are preferable. Melt flow rates (hereinafter abbriviated to MFR) of polypropylene resin and polyethylene resin used in the present invention are not specifically limited as long as they are in a range acceptable for spinning; preferably they are in the range of 1–100 g/10 min, and more preferably in the range of 5–70 g/10 min.

Preferred polypropylene resin is a propylene homopolymer or copolymer obtained by copolymerizing propylene with a small amount of ethylene and/or 1-butene, for example, isotactic polypropylene and syndiotactic polypropylene polymerized using Ziegler-Natta catalyst, metallocene catalyst or the like. MFR of the polypropylene resin is as described above, and MFR of the spun-out resin may be within the range of 10–100 g/10 min. More preferably, it may be in the range of 10–70/10 min. MFR of less than 10 g/10 min or more than 100 g/10 min will sometimes result in poor spinnability for filament.

On the other hand, polyethylene resin includes high density polyethylene (HDPE), linear low density polyethylene (LLDPE) and low density polyethylene (LDPE). High density polyethylene is most preferred. Further, a mixture of two or more of the above resins may be used. MFR of material polyethylene resin shall not be limited as long as it is melt-spinnable, and even the spinning condition is altered, there may occur no problem as long as MFR of the spun-out resin is within the range of 10–100 g/10 min. MFR of the spun-out resin is more preferably within the range of 10–60 g/10 min. The MFR less than 10 g/10 min or exceeding 100 g/10 min will sometimes result in poor spinnability for filament.

The polyolefin resins according to the invention further include stereoregular polystyrene.

Tacticity of the stereoregular polystyrene can be expressed in terms of an abundance ratio of a continuous plural number of a constitutional unit measured by $^{13}$C-NMR method. Stereoregular polystyrene used in the present invention includes polystyrene and polyalkylstyrene such as polymethylstyrene, polyethylstyrene and polyisopropylstyrene generally having a syndiotactic pentad ratio of 85% or more, more preferably 95% or more. The above polymers can be used alone or in mixture. A copolymer obtained from combination of the monomers which constitute the above polymers may also be used.

Also usable is a copolymer having a syndiotactic polystyrene structure prepared by copolymerizing one or more of the monomers selected from the above styrene monomers with one or more of the monomers selected from olefinic monomers such as ethylene, propylene, butene, hexene, heptene, octene, decene and the like; diene monomers such as butadiene, isoprene and the like; cyclic olefin monomer; and cyclic diene monomer.

Any combination of at least two different resins among the above polyolefin resins can be utilized for the present polyolefin splittable conjugate fiber. For the fiber to be used in the field of industrial materials or hygienic materials which require chemical resistance, a preferred combination is a combination of a polypropylene resin and a polyethylene resin which have a high resistance to chemicals and are advantageous in view of cost.

For the combination of a polypropylene resin and a polyethylene resin used for the present polyolefin splittable conjugate fiber, it is desirable that the polypropylene resin has a high melting point and the polyethylene resin has a low melting point.

Hereinafter, the high melting point resin may often be referred to as "resin A" and the low melting point resin as "resin B". These abridgements can also be applied to each resin mixed with an ethylene-vinyl alcohol copolymer.

According to the invention, the ethylene-vinyl alcohol copolymer to be added to at least one of polyolefin resins is a polymer obtained by saponifying an ethylene-vinyl acetate copolymer. Saponification degree is 95% or more, preferably 98% or more. Ethylene content in the copolymer is preferably 20–75 mol %. Lower saponification degree will bring poor spinnability of the mixture and render the mixture liable to softening, causing troubles during the processing process. Ethylene content less than 20 mol % will tend to deteriorate spinnability of the mixture as a mixing ratio in the copolymer becomes higher. Ethylene content more than 75 mol % will make it difficult to split the resulting splittable fiber. Thus, it is necessary to add a larger amount of the ethylene-vinyl alcohol copolymer in order to improve splittability of the splittable fiber. MFR of the ethylene-vinyl alcohol copolymer in the range of 5–100 g/10 min is acceptable.

The amount of the ethylene-vinyl alcohol copolymer to be added to the polyolefin resin is in the range of 1–30% by weight, preferably 2–20% by weight and more preferably 3–15% by weight. The amount less than 1% by weight will be little effective for improving splittability, while the amount more than 30% by weight will fail to uniformly disperse the ethylene-vinyl alcohol copolymer and be liable to deterioration in spinnability.

Additives such as antioxidant, photo-stabilizer, absorbent of ultra-violet ray, neutralizer, nucleating agent, epoxy stabilizer, lubricant, antibacterial agent, flame retardant, antistatic agent, pigment, plasticizer, hydrophilic agent and the like may be added to the polyolefin resin of the present invention within a range which does not adversely influence on the effect of the present invention, if needed.

Figure 2:
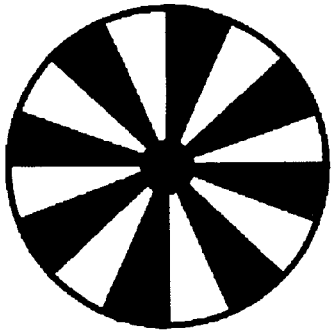
FIG. 2 is a cross sectional diagram of a splittable conjugate fiber in the invention.
Figure 3:
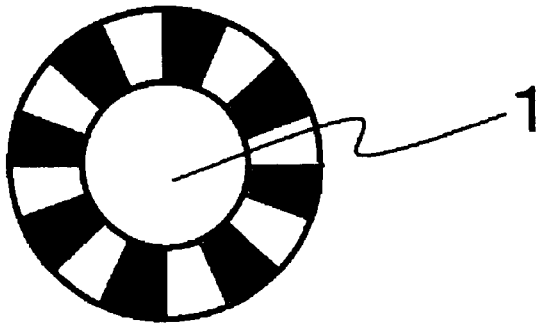
FIG. 3 is a cross sectional diagram of a splittable conjugate fiber in the invention.
Figure 4:
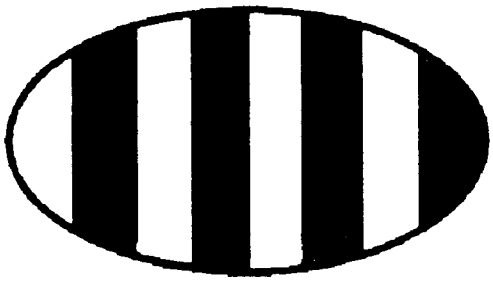
FIG. 4 is a cross sectional diagram of a splittable conjugate fiber in the invention.
Figure 5:
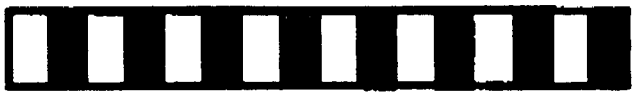
FIG. 5 is a cross sectional diagram of a splittable conjugate fiber in the invention.
Figure 6:
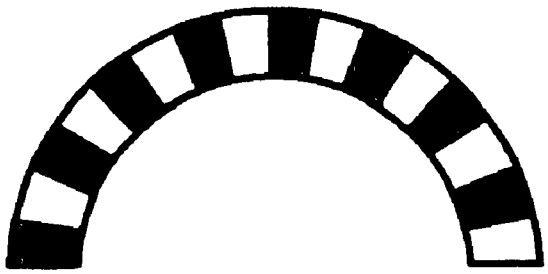
FIG. 6 is a cross sectional diagram of a splittable conjugate fiber in the invention.

The cross sectional structures of the polyolefin splittable conjugate fiber according to the present invention are illustrated in FIGS. 1 to 6 where two components are arranged alternately. FIGS. 1 and 2 show a radial splittable cross section in which each component is arranged alternately. FIG. 3 shows a hollow splittable cross section in which each component is arranged alternately. FIGS. 4 and 5 show a layer splittable cross section in which each component is arranged alternately in layer. FIG. 6 shows a splittable cross section in which each component arranged alternately is bent, bulged or flat. A splittable conjugate fiber comprising multi-components polyolefin resins, of course, assumes a cross sectional structure in which each of the multi-components is arranged in such a manner that components of the same kind do not neighbor each other. It should be noted that the cross sectional structures and shapes of the conjugate fiber shown in FIGS. 1 to 6 are model drawings, and that these cross sectional structures may optionally be deformed by various external strengths in the process of making fibers. Such deformation, however, is of no practical damage.

Of the above cross sectional structures, preferred are those illustrated in FIGS. 3, 5 and 6 where the contact interfacial area is relatively narrow and thus splittability is sperior. FIG. 3 illustrates a conjugate fiber in which two components of polyolefin resins (resin A and resin B) are arranged radially and alternately, with a hollow part in the core area. The hollow area in terms of hollow ratio is 5–40%, preferably 10–30%. The shape of the hollow part is not particularly limited. With the hollow ratio less than 5%, the contact area of the neighboring components is enlarged, and when a physical stress is applied onto the non-split fiber for producing a fine split fiber, the fiber is difficult to crush. Accordingly, it is necessary to apply a large splitting energy onto the contact area of two components. On the contrary, with the hollow ratio exceeding 40%, the contact area of the neighboring components becomes small, and forming of a fine fiber by splitting upon application of physical stress proceeds easily. It is difficult, however, to produce a splittable fiber while maintaining good spinnability and productivity. In other words, with the hollow ratio of 5–40%, preferably 10–30%, there can be produced a splittable fiber while maintaining good spinnability and productivity.

The hollow part may exist in other parts than the core part of a fiber. If a foaming agent is added to either of resin A or resin B during the process of spinning, a hollow part can also exist in either of the resins. This hollow part lies in the boundary of resins A and B, making the contact area of the neighboring components narrow. Thus, only a small impact energy is required for splitting, and splittability is remarkably enhanced. Foaming agents used include azodicarbonamide, barium azodicarboxylate, N,N-dinitrosopentamethylenetetramine, p-toluenesulfonylsemicarbazide, trihydrazinotriazine and the like. Periphery of the conjugate fiber may have a cross section of circle or profile such as elliptical and polygons including triangle to octangle.

FIGS. 5 and 6 illustrate a conjugate fiber comprising at least two components of polyolefin resins, in which each of the components is arranged alternately, and the cross sectional shape are bent, bulged or flat. A splittable conjugate fiber with a bent, bulged or flat cross section has a broader surface area and a smaller contact area of the beighboring components than one with a circular cross section, e.g., a radial or a laminated splittable conjugate fiber, when both fibers have the same segment number and fineness of a fiber, and therefore the former may receive a high pressure liquid flow more effectively than the latter and will be more splittable at an equal water pressure.

Further, a non-drawn fiber obtained in the spinning process is converged between two rolls having different rotation speeds and drawn with a large stress. In such a process, the fibers with a bent or bulged cross section receives a higher pressure compared with ones with a flat cross section. When staple fibers are to be made, each of the fibers is pressurized in the cutting process with equal or more strength to that in the drawing process. For these reasons, the splittable conjugate fibers with a bent or bulged cross section is more easily crushed than those with a flat cross section, leading to a partial splitting in the course of the fiber making process. Even with no occurrence of such splitting, a stress remains on the contact interface of each component in the fiber so that the fiber is in a easily splittable state.

As mentioned above, where splitting has proceeded partially, a paper making method can be suitably used. In that method, it is desirable that splitting has partially proceeded so that a web having a fine surface and good uniformity may be obtained. On the contrary, in order to diminish development of splitting to the utmost in the fiber making process, it is effective to set a low drawing ratio. It is practically preferable that the elongation of a drawn fiber should be controlled as being 20% or more of that of the non-drawn fiber.

The bent or bulged shape as used herein is not particularly restricted and includes, for instance, U-form, C-form, S-form, M-form, N-form, L-form and a wave form. Mixtures of the above types may also be used. Further, a flat shape includes I-form and also C- and U-forms whose bulged parts are pressed to a flat form, but the cross section of the fibers of the present invention is not restricted to those mentioned above.

In the splittable conjugate fiber with a bent, bulged or flat cross section, splitting proceeds partially, as seen in the above drawing or fiber cutting steps, due to a pressure generated between calendar rolls. Even a splittable conjugate fiber produced without a drawing process, such as a long splittable conjugate fiber produced by a spunlaying method, can be made into an aggregate of fine fibers by passing the fiber between pressurized calendar rolls.

In the polyolefin splittable conjugate fiber comprising two components of polyolefin resins according to the present invention, a conjugation ratio of the resins is in the range of 10/90 to 90/10 by volume, preferably 30/70 to 70/30 by volume.

Fineness of the single fiber prior to splitting in the polyolefin splittable conjugate fiber is not particularly restricted, and preferably 0.6–10 dtex, and more favorably 1–6 dtex. The fineness less than 0.6 dtex will often lower spinnability in the melt-spinning process, while the fineness largely exceeding 10 dtex will make it difficult to give a highly uniform fiber aggregate even the web obtained is split to a fine fiber by means of a high pressure water flow.

When the polyolefin splittable conjugate fiber is split by hydroentangling or the like, the average fineness of a single split fiber is preferably 0.5 dtex or less, and more preferably 0.3 dtex or less. Accordingly, split segment number of the splittable conjugate fiber may be set so as to make the average fineness of the split fiber 0.5 dtex or less. The more segment number is advantageous in that the fineness after splitting is smaller. However, in view of easiness in producing the splittable conjugate fiber, the segment number of 4–32 is practically preferred. Fineness of individual fibers is not necessarily identical. When the splittable conjugate fiber has not completely been split, there may exist plural numbers of fibers having different fineness in the middle of the completely split fiber and non-split fiber.

Given below is an exemplified method of producing the polyolefin splittable conjugate fiber of the present invention in which two components, polypropylene resin (resin A) and polyethylene resin (resin B), are combined and ethylene-vinyl alcohol copolymer is added to one of the components within the amount mentioned above.

The above two components are spun out to a filament by means of a conventional melt-spinning machine. The spinning temperature is preferably in the range of 180 to 300° C. and take-out speed is preferably in the range of 40 to 1500 m/min. A multi-step drawing may be carried out, if necessary, and the drawing ratio is preferably about 3- to 9-fold in general. Further, the tow obtained is crimped if required, and then is cut into a staple fiber of a prescribed length. The above is a manufacturing process of a staple fiber. On the other hand, the filament for tow may be formed into a web without cutting the tow, by means of fiber-separating guide or the like, which thereafter may be subjected, if necessary, to elaborate processing to give fiber structures for various uses. Instead of a staple fiber, a filament may be produced.

The fiber structure used herein may be any structure in a cloth-like form, for example, fabrics, knits and nonwovens. The fiber of the present invention may be subjected to fiber blending or mix spinning with other fibers to form a fiber structure. Further, the fiber structure may be a uniform web obtained by a carding method, an airlaying method or a paper making method, a fabric, a knit or laminated nonwovens.

As mentioned above, other fibers may be used for fiber blending or mix spinning with the splittable fiber of the present invention, as needed. Such other fibers include synthetic fibers obtained from polyamide, polyester, polyolefin, acrylics or the like, natural fibers obtained from cotton, wool, linen or the like, regenerated fiber or semi-synthetic fiber obtained from rayon, cupra, acetate or the like.

In such processes, a surface active agent may be deposited on the fiber surface after spinning for antistatic purpose or for imparting smoothness to the fiber so that processability in making a fiber structure can be improved. Type and concentration of the surface active agent can be selected or suitably adjusted depending on applications. Roller method or dipping can be used for deposition. The deposition may be carried out during any process of spinning, drawing and crimping. Further, in either of staple fiber or filament, a surface active agent can be deposited during the process other than spinning, drawing and crimping, for instance, after formation into a fiber structure.

The fiber length of the polyolefin splittable conjugate fiber according to the present invention is not particularly limited. Generally, it is in the range of 20 to 76 mm when making a web using a carding machine, and it is preferably in the range of 2 to 20 mm when making a web using a paper making method or an airlaying method. A fiber with less than 2 mm length will be moved by a physical impact so that the fiber is difficult to receive sufficient energy for splitting. Further, with a fiber largely exceeding 76 mm in length, a uniform web cannot be formed by using a carding machine or the like.

Shown below is a method of producing a nonwoven, as an example of the method of producing a fiber structure from the present splittable conjugate fiber. A web having a desired mass per unit area is formed using the staple fibers produced by the method described above by means of a carding method, an airlaying method or a paper making method. Otherwise, the web may be directly formed by means of a meltblowing method or a spunlaying method. The web thus formed may be split into a fine fiber by means of known methods such as needle punching and hydroentangling to obtain a fiber structure. Further, the fiber structure obtained may be treated further with a known processing method such as using a hot air or a heat roll. When a web constituted from a very short fiber produced by, e.g., a paper making method is split by means of known methods such as needle punching or hydroentangling, the fiber is liable to be moved by the physical impact applied thereby making the uniformity of the web deteriorated. In order to diminish such deterioration, a fiber which can melt at a lower temperature than that of the low melting resin constituting the present polyolefin splittable conjugate fiber may be mixed beforehand to make a nonwoven by thermal bonding of the lower melting point fiber.

The mass per unit area of the fiber structure of the present invention is not particularly limited, and it is preferably in the range of 10 to 200 g/m$^2$. A mass per unit area of less than 10 g/m$^2$ will sometimes result in a fabric with poor uniformity when splitting is carried out by means of a physical impact such as hydroentangling. On the other hand, a mass per unit area exceeding 200 g/m$^2$ is too high and it requires a higher-pressure water flow, and uniform splitting which can lead to a good uniformity may be difficult.

Hydroentangling shall be explained below. An apparatus used for hydroentangling is one having a large number of jet nozzles arranged in a line or lines at intervals of 0.1–1.5 mm, a nozzle diameter being 0.05–1.5 mm, especially 0.1–0.5 mm. A high-pressure liquid flow injected from jet nozzles at a high pressure collides with the web placed on a perforated sustaining article. Thus, non-split splittable conjugate fiber of the present invention is entangled and at the same time split into a fine fiber. The nozzles are arranged in lines to the direction perpendicular to the running direction of the above web. The high-pressure liquid may be water of normal temperatures or hot water, or any other liquids.

The distance between the jet nozzles and the web is preferably 10–150 mm. With the distance less than 10 mm, the fiber structure obtained by this treatment will show a poor uniformity. On the other hand, with the distance exceeding 150 mm, the physical impact on the web by the liquid flow will be weak, thus resulting in incompleteness in entanglement and splitting into the fine fiber. The pressure at the time of hydroentangling can be controlled depending on the production method or required performance of the fiber structure, and it may generally be 2–20 MPa. The pressure varies depending on the mass per unit area used, and a gradually increased pressure from low to high within the above range is advantageously applied, which enables good entanglement and splitting into a fine fiber without deteriorating uniformity of the web. The perforated sustaining article on which the web is placed during hydroentangling is not particularly limited as long as the high-pressure liquid flow can pass through the web, and includes a 50–200 mesh screen made of a metal net or a synthetic resin, or a perforated plate.

After hydroentangling one side of the web, the entangled web is then turned over so as to treat the other side. By so doing, there can be obtained a fiber structure with fine surface in both of the front and back sides. After hydroentangling, water is removed from the fiber structure by means of a known method. After water is removed to a certain degree by means of a squeezing apparatus such as a mangle, the residual water is completely removed using a drying apparatus such as a hot air circulating oven to give the fiber structure of the present invention.

The polyolefin splittable conjugate fiber of the invention is easier to split and receives less impact by a high-pressure liquid flow than the conventional ones, so that a fine fiber can be easily formed by splitting. Therefore, it is possible to obtain a fiber structure having a good uniformity even though hydroentangling, which is the rate determining step in the spun lace process, is carried out with a higher speed or under a reduced pressure. For example, in case of a web constituted from staple fibers as in a paper making method, a reduced pressure can be applied, so that the problems such as deterioration of uniformity of the fiber structure and opening of the penetrated part can be improved.

As described above, even a splittable conjugate fiber comprising polyolefin resins can be easily split to give a fiber structure having a fine surface and good uniformity. Further, the ethylene-vinyl alcohol copolymer to be added to the polyolefin resin has a fairly good chemical resistance and the amount to be added is small. Therefore, the fiber structure of the present invention can be suitably used in the fields of industrial materials such as battery separators, wipers, filters and the like as well as sanitary materials and medicines, all of which require a chemical resistance.

EXAMPLES

The present invention shall be explained below with reference to examples and comparative examples, but the present invention shall not be restricted to these examples. The technical terms and measuring methods of the physical properties in respective examples are shown below.

(1) Melt Flow Rate (MFR)

MFR was measured in accordance with JIS K7210.

When the material was a polypropylene resin, condition 14 was employed.

When the material was a polyethylene resin, condition 4 was employed.

When the material was a syndiotactic polystyrene, temperature was 300° C. and load was 21.18 N.

When the material was an ethylene-vinyl alcohol copolymer, condition 4 was employed.

(2) Spinnability

Spinnability on melt-spinning was evaluated on the following three-scale in terms of the occurrence of the fiber disconnection.

Good: No fiber disconnection occurred and operationality was good, shown by a symbol "○".

Fair: Fiber disconnection occurred 1–2 times per an hour, shown by a symbol "Δ".

Poor: Fiber disconnection occurred 4 times or more per an hour and operationality was not good, shown by a symbol "x".

(3) Melting point

Melting point was measured in accordance with JIS K7122 using a thermal analyzer DSC10 manufactured by E. I. DuPont and Nemours Co.

(4) Tensile strength and elongation of the fiber

Tensile strength and elongation of the fiber were measured in accordance with JIS L1013 using a sample with a test length of 100 mm at a tensile rate of 100 mm/min using an autograph AGS 500D manufactured by SHIMADZU CORPORATION.

(5) Evaluation of splittability (Preparation of a web from split fibers)

Into a blender called Osterizer Blender were introduced 500 ml of a deionized water and 1.0 g (fiber weight) of a splittable conjugate fiber of the present invention, and then stirred at 7900 rpm for 5 minutes. The resultant mixture was filtered through a Buchner funnel 12 cm in diameter and dried at 80° C. The web obtained was a web prepared from a mixture of the fibers completely split, partially split and not split.

(Preparation of a web from a non-split fibers)

Into a beaker were introduced 500 ml of a deionized water and 1.0 g (fiber weight) of a splittable conjugate fiber of the present invention and stirred for 10 seconds by means of a glass bar. The resultant mixture was filtered through a Buchner funnel 12 cm in diameter and dried at 80° C. The web obtained was a web constituted mostly from a non-split splittable conjugate fiber.

(Measurement of the reduction rate in air permeability)

The air permeability was measured by putting each of the webs prepared from split or non-split fibers between metal nets having a porosity of 150 meshes in accordance with JIS L10966.27A. The reduction ratio in air permeability was calculated according to the following formula.

Reduction ratio in air permeability (%)=(Air permeability of the non-split web−Air permeability of the split web/(Air permeability of the non-split web)×100

As the splitting ratio increases, the web becomes dense, the air permeability decreases and the reduction ratio increases. Accordingly, as the reduction ratio in air permeability increases, the splitting ratio of the splittable conjugate fiber increases. Consequently, a fiber with a large reduction ratio in air permeability is judged easy to split.

(6) Hydroentangling

A web produced by means of a roller carding machine, an airlaying machine, a paper making machine or the like was placed on a plain woven conveyer belt having a porosity of 80 meshes and was passed just under a nozzle 0.1 mm in diameter and 1 mm in nozzle pitch at a conveyer belt speed of 10 m/min, whereon injection of a high-pressure liquid flow was applied. This hydroentangling comprises a two-step pre-treatment at 2 MPa and a subsequent four-step treatment with a high pressure liquid flow at a water pressure of 5 MPa. The web was then turned over and an additional four-step treatment with a high pressure liquid flow at a water pressure of 5 MPa was carried out to give a nonwoven containing a part of split fine fiber. The term "step" used here means the number of web's passing just under the nozzles.

Example 1

A splittable conjugate fiber having the cross sectional structure and shape shown in FIG. 2 was spun using a nozzle designed for a splittable conjugate fiber wherein a polypropylene resin of a crystalline ethylene-propylene random copolymer (melting point: 145° C., MFR: 17) was used as resin A, and a mixture of 80 parts by weight of a high density polyethylene resin (melting point: 131° C., MFR: 16) and 20 parts by weight of an ethylene-vinyl alcohol copolymer (saponification degree: 99%, ethylene content: 47 mol %, MFR: 14 and melting point: 160° C.) was used as resin B, a mixing ratio of resin A and resin B being 50/50 by volume. In the take-up process, alkylphosphate potassium salt was attached to the fiber. The non-drawn fiber obtained was drawn at 90° C., to which a finishing agent for paper making was attached. The fiber was then cut to a length of 5 mm. The resulting splittable conjugate fiber was subjected to an evaluation of the splittability in accordance with the method described in the above (5).

Comparative Example 1

A splittable conjugate fiber comprising resin A and resin B was produced in accordance with Example 1, except that a high density polyethylene resin (melting point: 131° C., MFR: 16) was used as resin B, and splittability thereof was also evaluated in the same manner.

Example 2

A splittable conjugate fiber having the cross sectional structure and shape shown in FIG. 1 was spun using a nozzle designed for a splittable conjugate fiber wherein a polypropylene resin of a propylene homopolymer (melting point: 163° C., MFR: 16) was used as resin A, and a mixture of 90 parts by weight of a high density polyethylene resin (melting point: 131° C., MFR: 16) and 10 parts by weight of an ethylene-vinyl alcohol copolymer (saponification degree: 99%, ethylene content: 47 mol %, MFR: 14 and melting point: 160° C.) was used as resin B, a mixing ratio of resin A and resin B being 50/50 by volume. In the take-up process, alkylphosphate potassium salt was attached to the fiber. The non-drawn fiber obtained was drawn at 90° C., to which a finishing agent for paper making was attached. The fiber was then cut to a length of 5 mm. The resulting splittable conjugate fiber was subjected to an evaluation of the splittability in accordance with the method described in the above (5).

Comparative Example 2

A splittable conjugate fiber comprising resin A and resin B was produced in accordance with Example 2, except that a high density polyethylene resin (melting point: 131° C., MFR: 16) was used as resin B, and splittability thereof was also evaluated in the same manner.

Example 3

A splittable conjugate fiber having the cross sectional structure and shape shown in FIG. 3 was spun using a nozzle designed for a splittable conjugate fiber wherein a polypropylene resin of a propylene homopolymer (melting point: 163° C., MFR: 16) was used as resin A, and a mixture of 95 parts by weight of a high density polyethylene resin (melting point: 131° C., MFR: 16) and 5 parts by weight of an ethylene-vinyl alcohol copolymer (saponification degree: 99%, ethylene content: 47 mol %, MFR: 14 and melting point: 160° C.) was used as resin B, a mixing ratio of resin A and resin B being 50/50 by volume. In the take-up process, alkylphosphate potassium salt was attached to the fiber. The non-drawn fiber obtained was drawn at 90° C., to which a finishing agent for paper making was attached. The fiber was then cut to a length of 5 mm. The resulting splittable conjugate fiber was subjected to an evaluation of the splittability in accordance with the method described in the above (5).

Comparative Example 3

A splittable conjugate fiber comprising resin A and resin B was produced in accordance with Example 3, except that a high density polyethylene resin (melting point: 131° C., MFR: 16) was used as resin B, and splittability thereof was also evaluated in the same manner.

Example 4

A splittable conjugate fiber was produced in accordance with Example 3 using a polypropylene resin of a propylene homopolymer (melting point: 131° C., MFR: 16) as resin A, and a mixture of 97 parts by weight of a high density polyethylene resin (melting point: 131° C., MFR: 16) and 3 parts by weight of an ethylene-vinyl alcohol copolymer (saponification degree: 99%, ethylene content: 47 mol %, MFR: 14 and melting point: 160° C.) as resin B, and splittability thereof was also evaluated in the same manner.

Example 5

A splittable conjugate fiber was produced in accordance with Example 3 using a polypropylene resin of a propylene homopolymer (melting point: 131° C., MFR: 16) as resin A, and a mixture of 82 parts by weight of a high density polyethylene resin (melting point: 131° C., MFR: 16) and 18 parts by weight of an ethylene-vinyl alcohol copolymer (saponification degree: 99%, ethylene content: 47 mol %, MFR: 14 and melting point: 160° C.) as resin B, and splittability thereof was also evaluated in the same manner.

Example 6

A splittable conjugate fiber was produced in accordance with Example 2, except that cross sectional structure and shape of the fiber was as shown in FIG. 6. Evaluation of the splittability was conducted in the same manner.

Comparative Example 4

A splittable conjugate fiber was produced in accordance with Comparative Example 2, except that cross sectional structure and shape of the fiber was as shown in FIG. 6. Evaluation of the splittability was conducted in the same manner.

Example 7

A splittable conjugate fiber was produced in accordance with Example 3 using a polypropylene resin of a propylene homopolymer (melting point: 131° C., MFR: 16) as resin A, and a mixture of 90 parts by weight of a linear low density polyethylene resin (melting point: 123° C., MFR: 23) and 10 parts by weight of an ethylene-vinyl alcohol copolymer (saponification degree: 99%, ethylene content: 47 mol %, MFR: 14 and melting point: 160° C.) as resin B, and splittability thereof was also evaluated in the same manner.

Comparative Example 5

A splittable conjugate fiber comprising resin A and resin B was produced in accordance with Example 7 except that a linear low density polyethylene resin (melting point: 123° C., MFR: 23) was used as resin B. Evaluation of the splittability was conducted in the same manner.

Example 8

A splittable conjugate fiber was produced in accordance with Example 3 using a polypropylene resin of a propylene homopolymer (melting point: 131° C., MFR: 16) as resin A, and a mixture of 90 parts by weight of a low density polyethylene resin (melting point: 110° C., MFR: 20) and 10 parts by weight of an ethylene-vinyl alcohol copolymer (saponification degree: 99%, ethylene content: 47 mol %, MFR: 14 and melting point: 160° C.) as resin B, and splittability thereof was also evaluated in the same manner.

Comparative Example 6

A splittable conjugate fiber comprising resin A and resin B was produced in accordance with Example 8 except that a low density polyethylene resin (melting point: 110° C., MFR: 20) was used as resin B. Evaluation of the splittability was conducted in the same manner.

Example 9

A splittable conjugate fiber was produced in accordance with Example 6 using a mixture of 90 parts by weight of a polypropylene resin of a propylene homopolymer (melting point: 163° C., MFR: 16) and 10 parts by weight of an ethylene-vinyl alcohol copolymer (saponification degree: 99%, ethylene content: 47 mol %, MFR: 14 and melting point: 160° C.) as resin A, and a high density polyethylene resin (melting point: 131° C., MFR: 26) as resin B, and splittability thereof was also evaluated in the same manner.

Example 10

A splittable conjugate fiber having the cross sectional structure and shape shown in FIG. 3 was spun using a nozzle designed for a splittable conjugate fiber, wherein a syndiotactic polystyrene resin of a styrene homopolymer of the racemic modification (syndiotactic pentad ratio: 95%, melting point: 270° C.) was used as resin A, and a mixture of 90 parts by weight of a polypropylene resin (melting point: 163° C., MFR: 10) and 10 parts by weight of an ethylene-vinyl alcohol copolymer (saponification degree: 99%, ethylene content: 44 mol %, MFR: 6 and melting point: 165° C.) was used as resin B, a mixing ratio of resin A and resin B being 50/50 by volume. In the take-up process, alkylphosphate potassium salt was attached to the fiber. The non-drawn fiber obtained was drawn at 120° C. and also annealed at 150° C., to which a finishing agent for paper making was attached. The fiber was then cut to a length of 5 mm. The resulting splittable conjugate fiber was subjected to an evaluation of the splittability in accordance with the method described in the above (5).

Comparative Example 7

A splittable conjugate fiber comprising resin A and resin B was produced in accordance with Example 10, except that a polypropylene resin (melting point: 163° C., MFR: 10) was used as resin B. Evaluation of the splittability was conducted in the same manner.

Example 11

A splittable conjugate fiber having the cross sectional structure and shape shown in FIG. 3 was spun using a nozzle designed for a splittable conjugate fiber, wherein a syndiotactic polystyrene resin of a styrene homopolymer of the racemic modification (syndiotactic pentad ratio: 95%, melting point: 270° C.) was used as resin A, and a mixture of 90 parts by weight of a high density polyethylene resin (melting point: 131° C., MFR: 16) and 10 parts by weight of an ethylene-vinyl alcohol copolymer (saponification degree: 99%, ethylene content: 44 mol %, MFR: 6 and melting point: 165° C.) was used as resin B, a mixing ratio of resin A and resin B being 50/50 by volume. In the take-up process, alkylphosphate potassium salt was attached to the fiber. The non-drawn fiber obtained was drawn at 120° C., to which a finishing agent for paper making was attached. The fiber was then cut to a length of 5 mm. The resulting splittable conjugate fiber was subjected to an evaluation of the splittability in accordance with the method described in the above (5).

Example 12

A splittable conjugate fiber having the cross sectional structure and shape shown in FIG. 2 was spun using a nozzle designed for a splittable conjugate fiber wherein a polypropylene resin of a propylene homopolymer (melting point: 163° C., MFR: 16) was used as resin A, and a mixture of 88 parts by weight of a high density polyethylene resin (melting point: 131° C., MFR: 16), 10 parts by weight of an ethylene-vinyl alcohol copolymer (saponification degree: 99%, ethylene content: 47 mol %, MFR: 14 and melting point: 160° C.) and 2 parts by weight of a foaming agent master batch (DAI BLOW HC, LDPE with forming agent content of 20%, manufactured by DAINICHI SEIKA KOUGYO Co.) was used as resin B, a mixing ratio of resin A and resin B being 50/50 by volume. In the take-up process, alkylphosphate potassium salt was attached to the fiber. The non-drawn fiber obtained was drawn at 90° C., to which a finishing agent for paper making was attached. The fiber was then cut to a length of 5 mm. The resulting splittable conjugate fiber was subjected to an evaluation of the splittability in accordance with the method described in the above (5).

Comparative Example 8

A splittable conjugate fiber comprising resin A and resin B was produced in accordance with Example 12, except that a mixture of 98 parts by weight of a high density polyethylene resin (melting point: 131° C., MFR: 16) and 2 parts by weight of a foaming agent master batch (DAI BLOW HC, LDPE with forming agent content of 20%, manufactured by DAINICHI SEIKA KOUGYO Co.) was used as resin B. Evaluation of the splittability was conducted in the same manner.

Tables 1 and 2 below show the spinning and drawing conditions, physical properties of the fibers, conjugated structures and shapes, and reduced ratio in air permeability in reference to Examples 1–12 and Comparative Examples 1–8.

Example 13

The non-drawn fiber obtained in Example 3 was drawn at a draw ratio of 5.0 at 90° C., mechanically crimped and cut to a length of 51 mm. The staple fiber obtained was formed into a web by means of a roller card machine, and the web was then subjected to hydroentangling as described in the above (6). Drying at 80° C. with a dryer gave a fiber structure. The fiber structure had a very fine surface and good uniformity, and it was suitably used for a wiper.

Example 14

80 parts by weight of the splittable conjugate fiber obtained in Example 3 were mixed with 20 parts by weight of a sheath-core conjugate fiber (EAC fiber, manufactured by Chisso Corporation) comprising a polypropylene/a low density polyethylene to prepare a web by means of a square-type sheet machine (25 cm×25 cm) by a paper making method. After drying, pre-bonding was conducted at 105° C. to obtain a non-split web. The web obtained was subjected to hydroentangling as described in the above (6). Drying at 80° C. with a dryer gave a fiber structure. The fiber structure had a very fine surface and good uniformity, and it was suitably used for a wiper.

TABLE 1

| | Ex. 1 | Com. Ex. 1 | Ex. 2 | Com. Ex. 2 | Ex. 3 | Com. Ex. 3 | Ex. 4 | Ex. 5 | Ex. 6 | Com. Ex. 4 |
|---|---|---|---|---|---|---|---|---|---|---|
| Resin A | Co-PP | Co-PP | PP | PP | PP | PP | PP | PP | PP | PP |
| Resin B | HDPE | HDPE | HDPE | HDPE | HDPE | HDPE | HDPE | HDPE | HDPE | HDPE |

TABLE 1-continued

| | Ex. 1 | Com. Ex. 1 | Ex. 2 | Com. Ex. 2 | Ex. 3 | Com. Ex. 3 | Ex. 4 | Ex. 5 | Ex. 6 | Com. Ex. 4 |
|---|---|---|---|---|---|---|---|---|---|---|
| Ethylene-vinyl alcohol copolymer | | | | | | | | | | |
| Added to | Resin B | — | Resin B | — | Resin B | — | Resin B | Resin B | Resin B | — |
| Amount added (wt. %) | 20 | 0 | 10 | 0 | 5 | 0 | 3 | 18 | 10 | 0 |
| Cross sectional shape | FIG. 2 | FIG. 2 | FIG. 1 | FIG. 1 | FIG. 3 | FIG. 3 | FIG. 3 | FIG. 3 | FIG. 6 | FIG. 6 |
| Spinnability | ○ | ○ | ○ | ○ | ○ | ○ | ○ | ○ | ○ | ○ |
| Finess of drawn fiber (dtex/f) | 3.3 | 3.3 | 1.4 | 1.4 | 1.5 | 1.5 | 1.5 | 1.6 | 1.7 | 1.7 |
| Break strength (cN/dtex) | 3.1 | 3.4 | 4.6 | 4.5 | 4.3 | 4.2 | 4.5 | 4.0 | 3.0 | 3.3 |
| Elongation (%) | 45 | 41 | 36 | 40 | 41 | 40 | 40 | 46 | 45 | 42 |
| Reduction ratio in air peameability (%) | 25 | 4 | 39 | 10 | 55 | 30 | 50 | 57 | 59 | 35 |

PP : Polypropylene
HDPE : High density polyethylene
LLDPE : Linear low density polyethylene
LDPE : Low density polyethylene
SPS : Syndiotactic polystyrene
Co-PP : Ethylene-propylene random polymer

TABLE 2

| | Ex. 7 | Com. Ex. 5 | Ex. 8 | Com. Ex. 6 | Ex. 9 | Ex. 10 | Com. Ex. 7 | Ex. 11 | Ex. 12 | Com. Ex. 8 |
|---|---|---|---|---|---|---|---|---|---|---|
| Resin A | PP | PP | PP | PP | PP | SPS | SPS | SPS | PP | PP |
| Resin B | LLDPE | LLDPE | LDPE | LDPE | HDPE | PP | PP | HDPE | HDPE | HDPE |
| Ethylene-vinyl alcohol copolymer | | | | | | | | | | |
| Added to | Resin B | — | Resin B | — | Resin A | Resin B | — | Resin B | Resin B | — |
| Amount added (wt. %) | 10 | 0 | 10 | 0 | 10 | 10 | 0 | 10 | 10 | 0 |
| Cross sectional shape | FIG. 3 | FIG. 3 | FIG. 3 | FIG. 3 | FIG. 6 | FIG. 3 | FIG. 3 | FIG. 3 | FIG. 2 | FIG. 2 |
| Spinnability | ○ | ○ | ○ | ○ | ○ | ○ | ○ | Δ | ○ | ○ |
| Finess of drawn fiber (dtex/f) | 1.8 | 1.5 | 2.2 | 2.2 | 1.8 | 3.0 | 2.9 | 3.1 | 8.0 | 8.0 |
| Break strength (cN/dtex) | 3.2 | 3.0 | 2.0 | 21 | 4.4 | 12 | 1.2 | 1.2 | 3.2 | 3.5 |
| Elongation (%) | 45 | 44 | 34 | 31 | 43 | 9 | 9 | 10 | 30 | 35 |
| Reduction ratio in air peameability (%) | 46 | 26 | 53 | 30 | 51 | 40 | 15 | 40 | 52 | 28 |

PP: Polypropylene
HDPE: High density polyethylene
LLDPE: Linear low density polyethylene
LDPE: Low density polyethylene
SPS: Syndiotactic polystyrene
Co-PP: Ethylene-propylene random polymer Comparisons between Example 1 and Comparative Example 1, Example 2 and Comparative Example 2, Examples 3–5 and Comparative Example 3, Example 6 and Comparative Example 4, Example 7 and Comparative Example 5, Example 8 and Comparative Example 6, and Example 10 and Comparative Example 7 based on the data shown in Tables 1 and 2 reveals that a higher reduction ratio in air permeability is attained by addition of the ethylene-vinyl alcohol copolymer. Thus, the addition of said copolymer is found effective. In other words, with the addition of the ethylene-vinyl alcohol copolymer, it is easy to produce split fine fibers by merely stirring the fiber in a blender using water as a medium, instead of conventional hydroentangling. Consequently, even a nonwoven having a relatively low mass per unit area can be split without deteriorating the uniformity. Further, expenditure for hydroentangling may be largely reduced.

Applicability of Industrial Uses

The splittable conjugate fiber of the present invention is so easy to split that the production of fine fiber by splitting is possible without a large physical impact applied. Thus, a fiber structure having a fine and even surface can be easily obtained. The fiber structure is usable for the fields of industrial materials such as a battery separator, a wiper, a filter and the like, and hygienic materials such as a diaper, a napkin and the like.

What is claimed is:

1. A polyolefin splittable conjugate fiber comprising at least two components of polyolefin resins and having a cross sectional structure with each of the components arranged alternately and having a segment number of 4–32, wherein at least one of the component resins contains 1–30% by weight of an ethylene-vinyl alcohol copolymer whose saponification degree is 95% or more.

2. The polyolefin splittable conjugate fiber according to claim 1, wherein each component of the polyolefin resins comprises a polypropylene resin phase and a polyethylene resin phase.

3. The polyolefin splittable conjugate fiber according to claim 1, wherein at least one component of the polyolefin resins comprises a stereoregular polystyrene resin.

4. The polyolefin splittable conjugate fiber according to claim 1, wherein the conjugate fiber is a hollow fiber.

5. The polyolefin splittable conjugate fiber according to claim 1, wherein a foaming agent is added to at least one component of the polyolefin resins.

6. The polyolefin splittable conjugate fiber according to claim 1, wherein the conjugate fiber has a bent, bulged or flat cross section.

7. A fiber structure comprising the polyolefin splittable conjugate fiber according to claim 1 wherein the fiber structure is formed by needle punching or hydroentangling.

* * * * *